US005669358A

United States Patent [19]

Osakabe

[11] Patent Number: 5,669,358

[45] Date of Patent: Sep. 23, 1997

[54] ENGINE FUEL SUPPLY SYSTEM

[75] Inventor: Takayuki Osakabe, Hamamatsu, Japan

[73] Assignee: Sanshin Kogyo Kabushiki Kaisha, Hamamatsu, Japan

[21] Appl. No.: 622,962

[22] Filed: Mar. 27, 1996

[30] Foreign Application Priority Data

Mar. 27, 1995 [JP] Japan ..... 7-068089

[51] Int. Cl.[6] ..... F02M 37/04; F02B 33/04

[52] U.S. Cl. ..... 123/509; 123/196 W; 123/73 A

[58] Field of Search ..... 123/509, 516, 123/514, 195 P, 456, 196 W, 73 R, 73 A

[56] References Cited

U.S. PATENT DOCUMENTS

| | | | |
|---|---|---|---|
| 5,036,822 | 8/1991 | Kojima | 123/509 |
| 5,103,793 | 4/1992 | Riese et al. | 123/509 |
| 5,309,885 | 5/1994 | Rawlings et al. | 123/509 |
| 5,321,958 | 6/1994 | Takahashi et al. | 123/73 A |
| 5,389,245 | 2/1995 | Jaeger et al. | 123/514 |
| 5,425,336 | 6/1995 | Nakayama | 123/195 P |
| 5,450,831 | 9/1995 | Fukuoka | 123/509 |
| 5,501,202 | 3/1996 | Watanabe | 123/509 |
| 5,505,166 | 4/1996 | Katoh | 123/73 A |

*Primary Examiner*—Thomas N. Moulis

*Attorney, Agent, or Firm*—Knobbe, Martens, Olson & Bear, LLP

[57] ABSTRACT

A fuel system for an outboard motor includes a low-pressure fuel transport subsystem and a high-pressure fuel delivery system. The fuel transport system guides fuel from a fuel tank located in the hull of the watercraft to a fuel tank located with a cowling surrounding the engine. The high-pressure fuel delivery system supplies fuel to a fuel rail that communicates with fuel injectors of the engine's induction system. The induction system communicates with crankcase chambers on a side of the engine opposite of the engine cylinders. The low-pressure fuel transport subsystem is located on a side of the induction system opposite of the high-pressure fuel delivery subsystem. This layout minimizes the flow path length from the fuel tank within the cowling to the fuel rail. It also reduces the girth of the engine and simplifies the arrangement of the fuel hoses of the fuel supply system.

20 Claims, 11 Drawing Sheets

ENGINE FUEL SUPPLY SYSTEM

BACKGROUND OF THE INVENTION

1. Field of the Invention

The present invention relates in general to an internal combustion engine. In particular, the present invention relates to a fuel supply system for a marine engine.

2. Description of Related Art

A conventional fuel supply system for an outboard motor often includes a fuel tank located in the hull of the watercraft. A low-pressure pump, which is positioned within a cowling surrounding the engine of the outboard motor, draws fuel through a low-pressure filter and into a vapor separator tank in which fuel is stored. A high-pressure pump supplies the stored fuel in the vapor separator tank to the fuel supply rail which communicates with fuel injectors of the engine.

A conventional layout of the fuel supply system in the engine commonly places the low- and high-pressure fuel systems on the same side of the engine. A distance from the vapor separator to the fuel supply rail, however, tends to be quite long. Moreover, because each component is crammed in a small and limited space, the arrangement of the fuel supply hoses is very complicated, resulting an increased size of the system.

SUMMARY OF THE INVENTION

A need therefore exists for an improved layout of a fuel supply system of an outboard motor which minimizes the girth of the engine as well as shortens the conduit length between the fuel tank within the engine cowling and the charge formers of the engine.

An aspect of the present invention involves an engine comprising multiple cylinders. A plurality of crankcase chambers each communicating with a respective cylinder. An induction system is attached to a crankcase member of the engine on a side opposite of the cylinders. A fuel supply system includes a low-pressure fuel transport subsystem located on one side of the induction system and a high-pressure fuel delivery subsystem located on an opposite side of the induction system. This layout of the fuel supply system minimizes the flow path length of fuel within the high-pressure fuel delivery system to the induction system. It also reduces the girth of the engine and simplifies the arrangement of the components of the fuel supply system.

Another aspect of the present invention involves an engine including a variable-volume combustion chamber. A charge former communicates with the combustion chamber and a fuel supply system delivers fuel to the charge former. The fuel supply system includes a fuel transport subsystem which supplies fuel to a fuel delivery subsystem. The fuel delivery subsystem in turn communicates with the charge former to supply the charge former with fuel. The fuel transport subsystem and the fuel delivery subsystem are disposed on the engine at separate locations with the fuel delivery subsystem being positioned proximate to the charge former.

BRIEF DESCRIPTION OF THE DRAWINGS

These and other features of the invention will now be described with reference to the drawings of preferred embodiments which are intended to illustrate and are not to limit the invention, and in which.

DETAILED DESCRIPTION OF THE PREFERRED EMBODIMENTS

Figure 1:
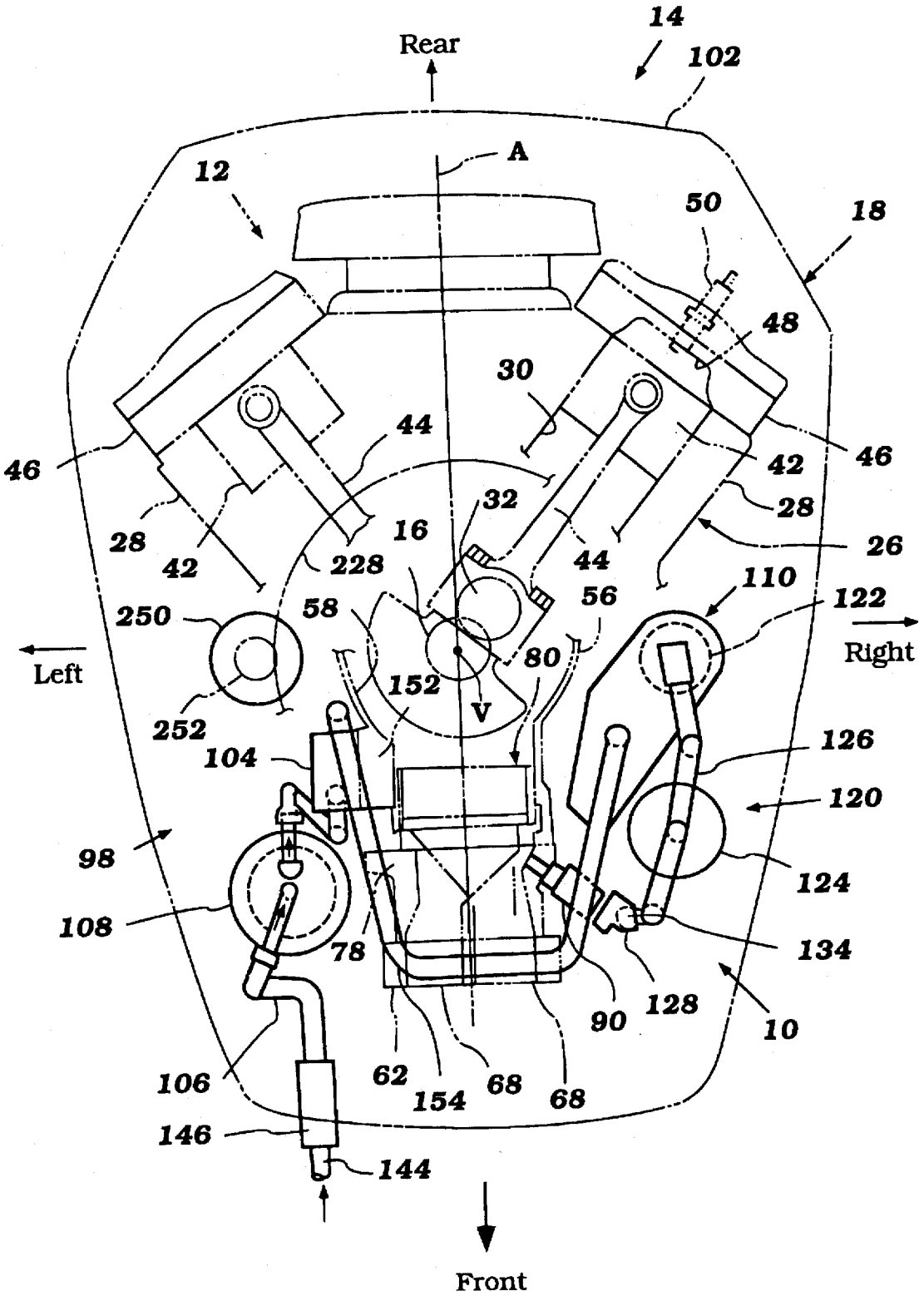
FIG. 1 is a top plan view of a fuel supply system for internal combustion marine engine configured in accordance with a preferred embodiment of the present invention, with several components of the marine engine illustrated in phantom-lines.

FIG. 1 illustrates a fuel supply system 10 for a marine engine 12 configured in accordance with a preferred embodiment of the present invention. The present fuel supply system 10 has particular utility with marine drives employing two-cycle, crankcase compression, V-type internal combustion engines as the power unit. Because outboard motors commonly employ such engines, the fuel supply system 10 is described below in connection with an outboard motor 14 (FIG. 2); however, the depiction of the invention in conjunction with an outboard motor is merely exemplary. Those skilled in the art will readily appreciate that the present fuel supply system can be applied to an inboard motor of an inboard/outboard drive, to an inboard motor of a personal watercraft, and to other types of watercraft engines as well.

Figure 2:
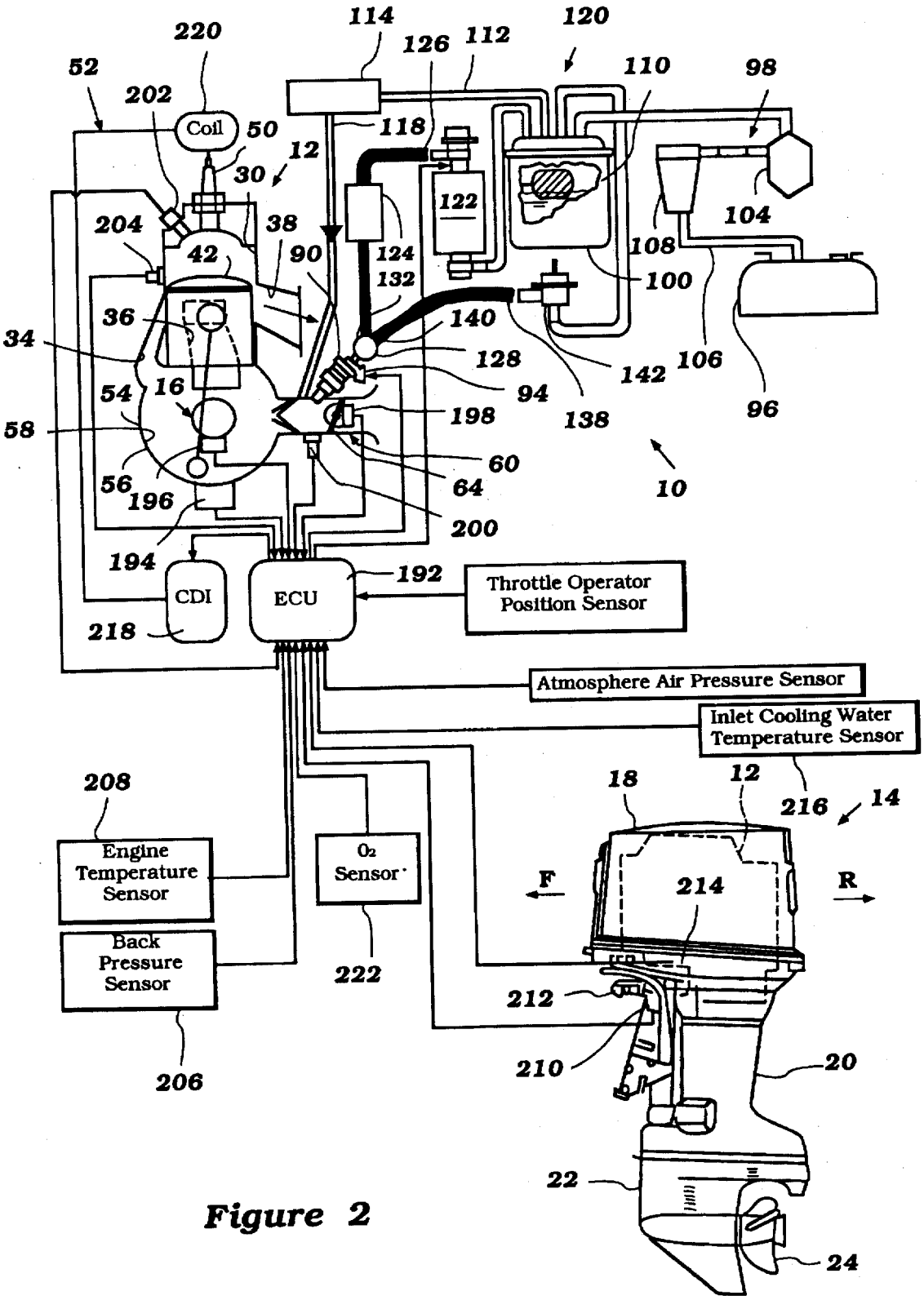
FIG. 2 is a schematic illustration of the fuel supply system of FIG. 1 and of a fuel injection control system shown in reference to one of the cylinders of the marine engine.

As understood from FIG. 1, the engine 12 is mounted conventionally with its output shaft 16 (e.g., crankshaft) rotating about a generally vertical axis V. The crankshaft 16 drives a drive shaft (not shown) which depends from the power head 18 of the outboard motor and extends through and is journaled within a drive shaft housing 20 (FIG. 2). The drive shaft depends into the lower unit 22 to drive a propulsion device 24, such as, for example, a propeller or a hydrodynamic jet.

The engine 12 desirably is a reciprocating multi-cylinder engine operating on a two-cycle crankcase compression principle. In the illustrated embodiment, the engine 12 has a V-type configuration, and specifically a V-6 cylinder arrangement. The present invention, however, may be applicable to engines having other cylinder arrangements, such as, for example, in-line or slant cylinder arrangements, and operate on other than a two-cycle crankcase compression principle, such as, for example, a four-cycle principle.

A cylinder block assembly 26 lies generally at the center of the engine 12. The cylinder block includes a pair of inclined cylinder banks 28. The cylinder banks 28 extend at an angle relative to each other to give the engine a conventional V-type configuration. As understood from FIG. 1, a vertical central plane A lies between the cylinder banks 28 and bifurcates the engine 12. The vertical axis V about which the crankshaft 16 rotates desirably lies within the central plane A.

Each cylinder bank 28 includes a plurality of parallel cylinder bores 30. A cylinder liner (not shown) forms each cylinder bore 30. The cylinder liner is cast or pressed in place in the cylinder bank 28. As is typical with V-type engine arrangements, the cylinder bores 30 of the first cylinder bank 28 are offset slightly in the vertical direction from the cylinders bores 30 of the second cylinder bank 28 so that the connecting rods of adjacent cylinders can be journalled on the same throw 32 of the crankshaft 16, as known in the art.

As understood from FIG. 2, each cylinder includes a plurality of scavenge passages 34, 36 formed in the cylinder block. In the illustrated embodiment, each cylinder includes a main scavenge passage 34 and a pair of circumferentially disposed side scavenge passages 36. The scavenge passages 34, 36 terminate in respective scavenge ports formed in the cylinder liner.

An exhaust passage 38 communicates with the cylinder bore 30 through an exhaust port. The exhaust port is formed in the cylinder liner and desirably lies diametrically opposite of the main scavenge port and between the side scavenge ports. The configuration of the ports desirably is designed to provide a Schnurle-type scavenging in the cylinder.

The exhaust passages 38 associated with the cylinders of each cylinder bank 28 lead away from the respective cylinder and merge into an exhaust system (not shown). The exhaust system discharges engine exhaust from the outboard motor 14 in a conventional manner.

As seen in FIGS. 1 and 2, a piston 42 reciprocates within each cylinder bore 30. Connecting rods 44 link the pistons 42 to the crankshaft 16 so that reciprocal linear movement of the pistons 42 rotate the crankshaft 16 in a known manner. The crankshaft 16 rotates about the vertical axis V. The crankshaft includes a plurality of spaced rod journals 32 which lie off axis from the crankshaft 16. An end of one of the connecting rods 44 is coupled to the rod journal 32 so as to link the corresponding piston 42 to the crankshaft 16 in a known manner.

A cylinder head assembly 46 is affixed to each of the cylinder banks 28 by conventional fasteners. Each cylinder head assembly 46 includes a plurality of recesses 48. One recess 48 cooperates with each cylinder bore 30 to close an end of the cylinder. The recess 48 in the cylinder head 46 and the corresponding cylinder bore 30 and piston 42 together define a variable volume chamber which, at minimum volume, defines the combustion chamber.

Spark plugs 50 are mounted in the cylinder head assemblies 46. A spark gap of each spark plug 50 lies generally at the center of the corresponding recess 48 of the cylinder head 46; however, the spark plug 50 can have other positions and orientations in the combustion chamber in order to improve stratification of the fuel charge about the spark gap of the spark plug 50, as known in the art. An ignition system 52 (FIG. 2) fires the spark plugs 50, as described below.

As seen in FIGS. 1 and 2, a skirt 54 of the cylinder block assembly 26 and a crankcase member 56 (not shown) cooperate to form the crankcase. The crankcase is divided into a plurality of chambers 58, with each chamber 58 communicating with a respective cylinder bore 30 through the corresponding scavenge passages 34, 36. Adjacent crankcase chambers 36 are sealed from each other.

Figure 3:
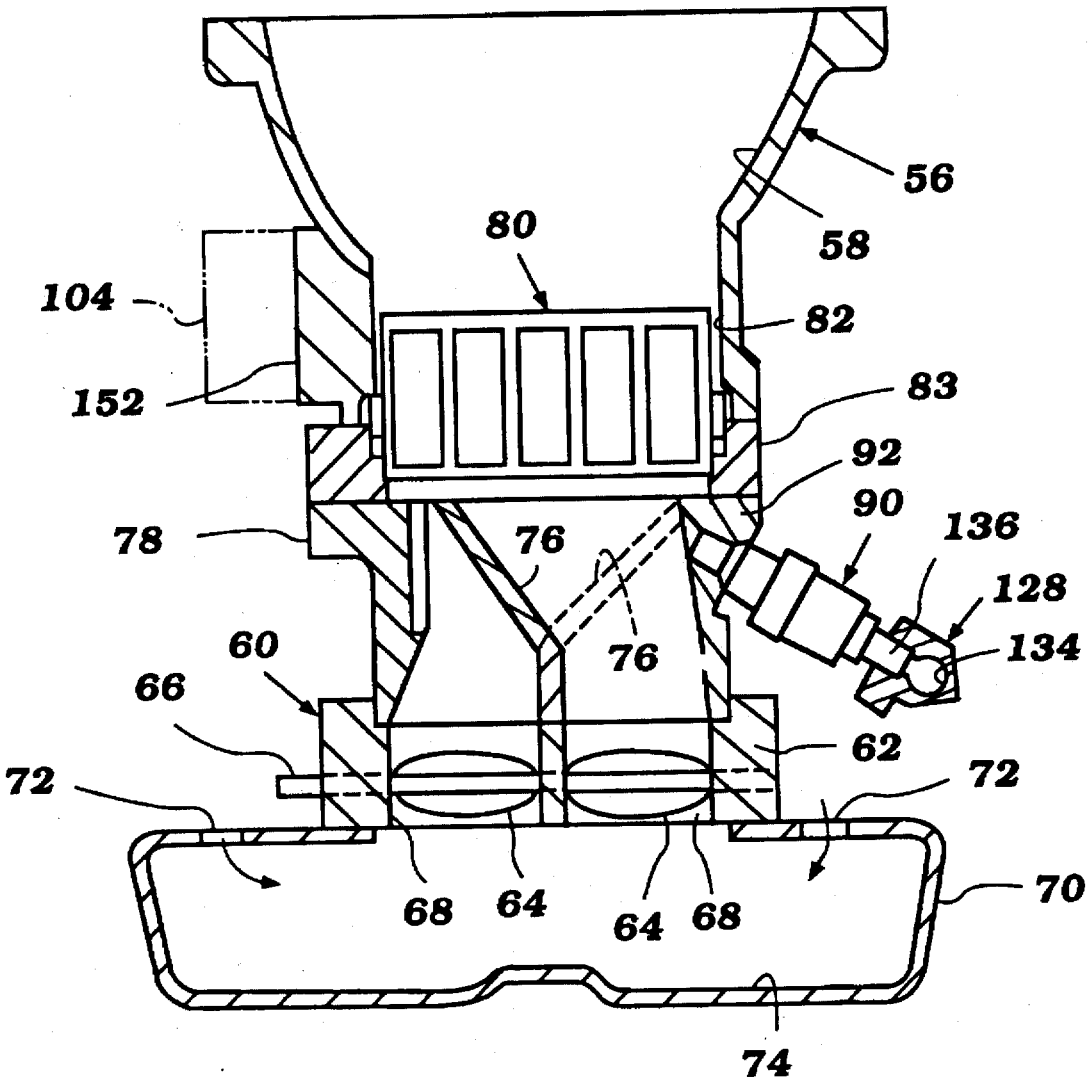
FIG. 3 is a top plan cross-sectional view of an induction system of the marine engine of FIG. 1.
Figure 4:
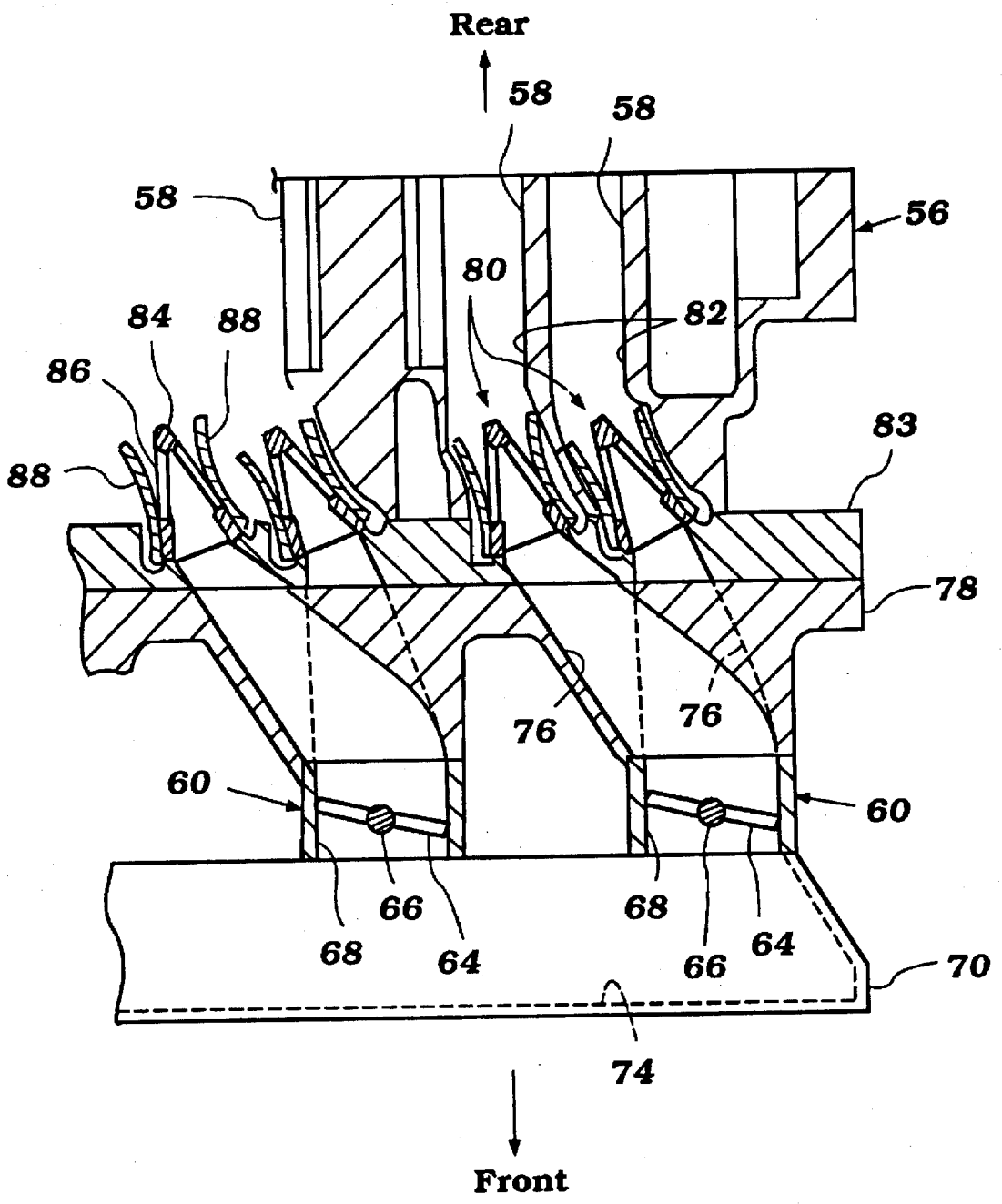
FIG. 4 is a partial side, cross-sectional view of the induction system of FIG. 3.

As best illustrated in FIGS. 2 through 4, an induction system which communicates with each crankcase chamber 58. In the illustrated embodiment, the induction system includes a plurality of throttle devices 60 to control the air flow into the engine 12. The throttle devices 60 desirably correspond in number to the number of crankcase chambers 58. Each throttle device 60 is dedicated to control air flow in a respective crankcase chamber 58.

The throttle devices 60 can, for example, be throttle valve assemblies; however, other conventional throttle devices can be used to regulate air flow into the crankcase chambers 58. Each throttle assembly 60 includes a throttle body 62 which houses at least one throttle valve 64. A throttle shaft 66 supports the valve 64 within a throttle passage 68 defined within the throttle body 62.

In the illustrated embodiment, as best understood from FIGS. 3 and 4, a throttle body 62 includes two adjacent throttle passages 68. A throttle valve 64 operates within each passage 68 and a single throttle shaft 66 passes through both the passages 68 and supports the respective valve 64 within each passage 68.

Each throttle valve passage 68 communicates with an intake silencer 70 of the induction system. The intake silencer 70 includes a plurality of inlets 72 positioned to the sides of the throttle bodies 62. The inlets 72 open into a plenum chamber 74 which communicates with each of the throttle passages 68 of the throttle devices 60.

A throttle linkage (not shown) desirably connects the throttle shafts 66 together so as to uniformly and simultaneously operate and control the throttle valves 64 in a known manner. Inlet air flow through the plenum chamber 74 and passes through each throttle device 60 when the linkages rotates the corresponding throttle shaft 66 to open the throttle valve 64.

Each throttle passage 68 communicates with a respective intake passage 76 formed in an intake manifold 78. The intake 76 passage in turn communicates directly which a corresponding crankcase chamber 58.

In the illustrated embodiment, as best understood from FIGS. 3 and 4, the inlets to an adjacent pair of intake passages 76 lie next to each other and communicate with the corresponding throttle passage 68. One of the intake passages 76 of the pair extends below the other passage 76 to communicate with the crankcase chamber 58 immediately beneath the crankcase chamber 58 with which the upper passage of the pair communicates. In this manner, the inlets to the adjacent pair of intake passages 76 lie at the same level, while the outlet of the intake passages 76 lie at different level so that each passage communicates with one of two crankcase chambers 58 which are arranged one above the other. FIG. 4 best illustrates the overlapping layout of the corresponding pairs of intake passages 76 of the intake manifold 78.

Each intake passage 76 delivers the fuel/air charge to the respective crankcase chamber 58 through a read-type check valve 80 connected to the intake manifold 78. The read-type check valve 80 permits air to flow into the crankcase chamber 58 through an inlet channel 82 defined by the crankcase member 56 when the corresponding piston 42 moves toward top dead center (TDC), but precludes reverse flow when the piston 42 moves toward bottom dead center (BDC) to compress the charge delivered to the crankcase chamber 58.

The reed-type check valves 80 are mounted to a support plate 83 that lies between the intake manifold 78 and the crankcase member 56. As seen in FIG. 4, each reed-type check valve 80 includes a mounting cage 84 that generally has a V-shape configuration. An apex edge of each mounting cage generally lies parallel to the rotational axis V of the crankshaft 16. Reed-type valve plates 86 are affixed to opposite sides of the cage 84 in a suitable manner with the down-stream ends of the valve plates 86 able to move relative to the cage 84. Stopper plates 88 lie to the outside of the valve plates 86 to limit the opening degree of the valve plates 86, as known in the art.

With reference to FIGS. 2 and 3, at least one fuel injector 90 injects fuel into the air stream passing through each intake passage 76; it is understood, however, that other types of charge formers, such as, for example, carburetors can also be used to form a fuel charge. In the illustrated embodiment, the intake manifold 78 includes at least one boss 92 associated with each intake passage 76 on one side of the manifold 78. Each boss 92 receives a fuel injector 90. The boss 92 supports the fuel injector 90 so that a spray axis of the fuel injector 90 generally aligns with the center of the bight of the valve cage 84. In this manner, the fuel injector 90 sprays fuel toward the center of the valve 80 to facilitate uniform mixture of the fuel/air charge passing through the valve 80.

Each fuel injector 90 includes a solenoid winding 94 which is energized in the manner described below. When energized, the fuel injector 90 injects fuel into the air stream passing through the intake passage 76 in the intake manifold 78.

Figure 5:
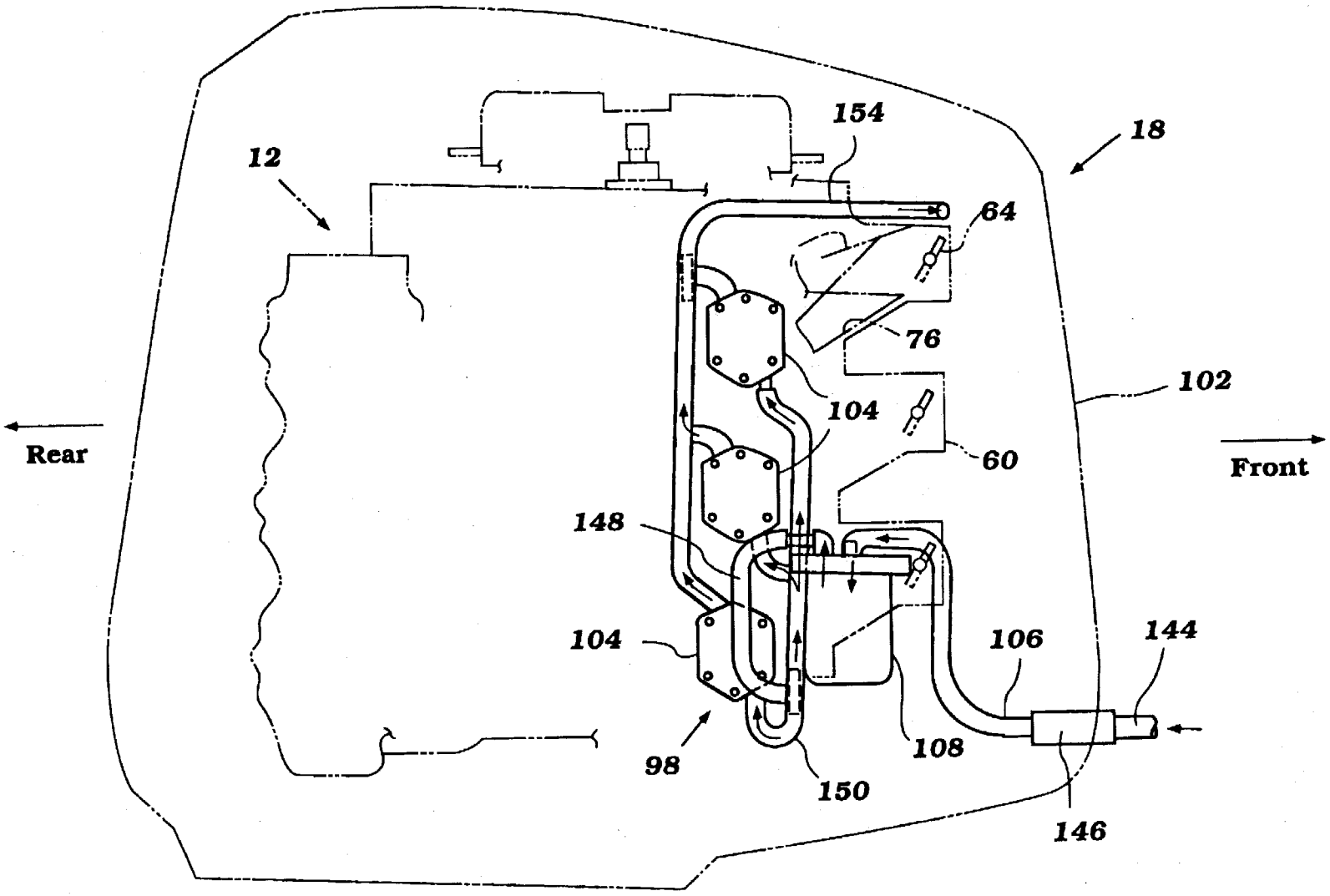
FIG. 5 is a port side elevational view of the fuel supply system of FIG. 1 with several components of the marine engine illustrated in phantom-lines.
Figure 6:
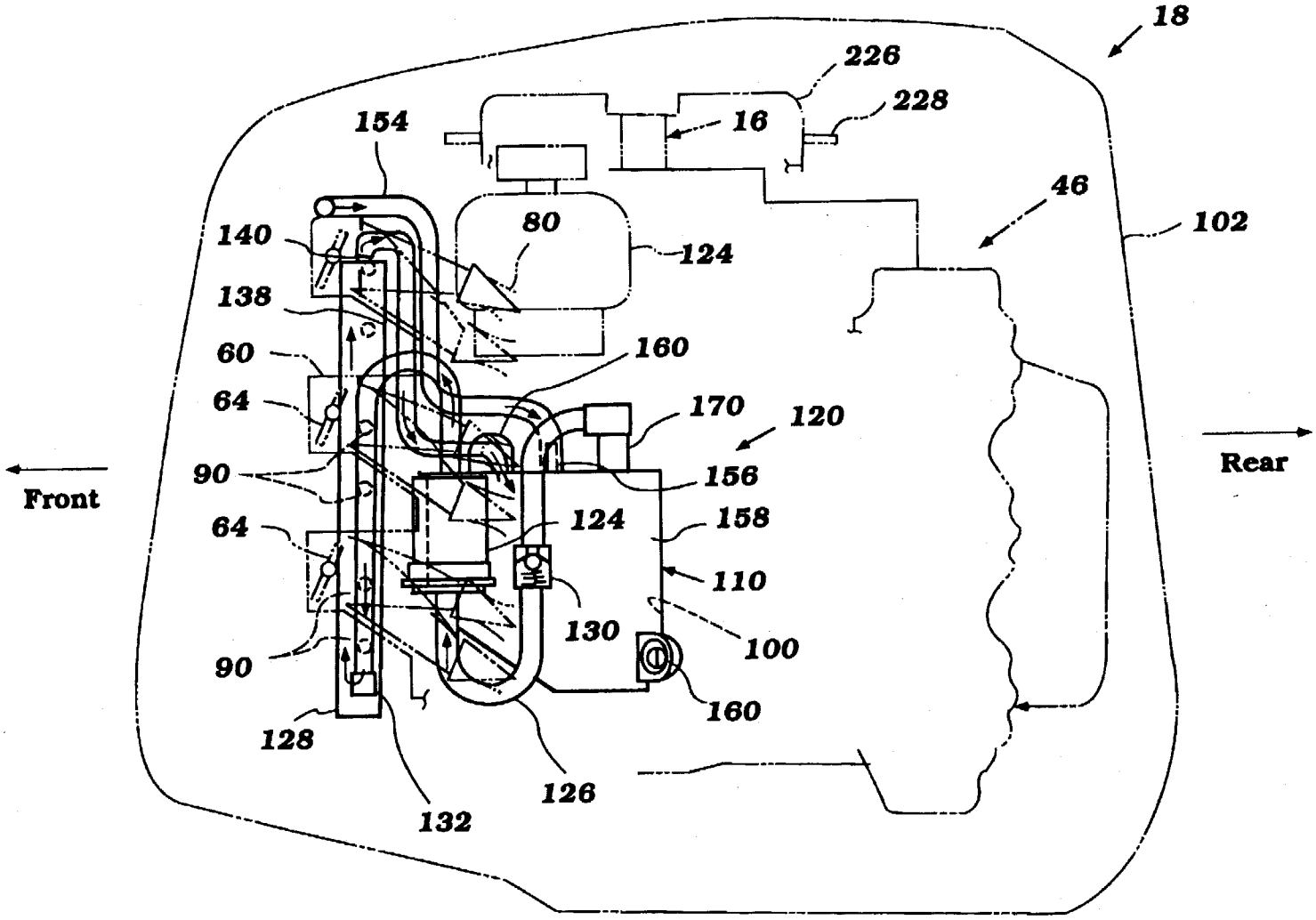
FIG. 6 is a starboard side elevational view of the fuel supply system of FIG. 1 with several components of the marine engine illustrated in phantom-lines.

With reference to FIGS. 2, 5 and 6, the fuel supply system 10 delivers fuel to each fuel injector 90. The fuel system includes a fuel tank 96 (FIG. 2) which is provided externally of the outboard drive 14, normally within the hull of the watercraft. A fuel transport subsystem 98 of the fuel supply system 10 supplies fuel to a fuel bowl 100 positioned within a cowling 102 of the outboard motor 14 which surrounds the engine 12.

A plurality of low-pressure pumps 104 of the fuel transport subsystem 98 draw fuel from the external fuel tank 96, through a conduit 106 and through a fuel filter 108. The fuel filter 108 separates water and other contaminates from the fuel. The low-pressure fuel pumps 104 supply fuel to the fuel bowl 100 of a vapor separator 110.

The vapor separator 110 separates fuel vapor and other gases from the liquid fuel within the fuel bowl 110, as explained below in detail. As seen in FIG. 2, gaseous vapors flow from the fuel bowl 100, through a conduit 112, and into a canister 114. A pressure-relief valve 116 in a discharge conduit opens 118 once the pressure of the fuel vapors within the canister 114 reach a preselected level. With the relief valve 116 opened, the fuel vapor flows through the conduit 118 and discharges into at least one of the intake passages 76 of the intake manifold 78 downstream of the corresponding fuel injector 90.

A high-pressure fuel delivery subsystem 120 supplies fuel to the fuel injectors 90 of the induction system. A high-pressure fuel pump 122 draws fuel from the fuel bowl 100 of the vapor separator 110 and pushes the fuel through a fuel filter 124. The high-pressure pump 122 desirably has at least two speeds in order vary the fuel flow rate through the delivery subsystem 120, as described below.

A conduit 126 connects the high-pressure pump 122 to a fuel rail or manifold 128 with the fuel filter 124 positioned within the conduit 126 between the pump 122 and fuel rail 128. The pump 122 delivers fuel under high pressure through the conduit 126 to the fuel rail 128. A check valve 130 (FIG. 6) is disposed in the conduit 126 upstream of the filter 124 to prevent a back-flow of fuel from the fuel rail 128.

The fuel rail 128 has an elongated shape and is vertically disposed. A lower inlet port 132 of the fuel rail 128 communicates with the conduit 126 carrying fuel from the high pressure pump 122. The inlet port 132 opens into a manifold chamber 134 which extends along the length of the fuel rail 128.

The fuel rail 128 delivers fuel to each fuel injector 90. For this purpose, the manifold chamber 134 communicates with a plurality of supply ports defined along the length of the fuel rail 128. As best understood from FIG. 3, each supply port receives an inlet end 136 of the corresponding fuel injector 90. The supply port communicates with an inlet port to the fuel injector 90 to supply the fuel injector 90 with fuel.

With reference to FIG. 2, a fuel return line 138 extends between an outlet port 140 of the fuel rail 128 and the fuel bowl 100 of the vapor separator 110. The return line 138 complete a flow loop defined by the high-pressure fuel delivery subsystem 120 to generally maintain a constant flow of fuel through the fuel rail 128. The constant fuel flow through the fuel delivery subsystem 120 inhibits heat transfer to the fuel and thus reduces fuel vaporization within the fuel rail 128. The vertical orientation also facilitates separation of any fuel vapor which occurs within the fuel delivery subsystem 120 from the fuel flow into the injectors 90.

A pressure regulator 142 desirably lies within the fuel loop, as schematically illustrated in FIG. 2. The pressure regulator 142 generally maintains a uniform fuel pressure at the injectors 90 (e.g., 50–100 atm). The regular 142 regulates pressure by dumping excess fuel back to the vapor separator 110, as known in the art. In the illustrated embodiment, the pressure regulator 142 is integrally formed with the fuel rail 128, between the manifold chamber 134 and the outlet port 140.

FIGS. 1, 5 and 6 best illustrate the arrangement of the components of the fuel supply system 10 within the cowling 102. As seen in FIG. 1, the fuel transport subsystem 98 generally lies on one side (e.g., the left side) of induction system and the fuel delivery subsystem 120 generally lies on the other side (e.g., the right side). In the illustrated embodiment, the a flexible fuel intake conduit 144 connects to a conventional quick-connect coupling 146 positioned at the front-left side of the cowling 102. An internal conduit 106 connects the coupling 146 to the fuel filter 108 to place the filter 108 in communication with the fuel intake conduit 144.

As seen in FIG. 5, the internal conduit 106 attaches to an inlet port on an upper side of the filter 108. On output line 148 connects an outlet port on the filter 108 to pump manifold 150. The line 148 communicates with the pump manifold 150 at a point proximate to an influent port of the lowest positioned low-pressure pump 104 to inhibit the occurrence of a vapor lock within the system 10, as known in the art.

The manifold 150 communicates with the influent port of each of the low-pressure pumps 104. In the illustrated embodiment, the fuel transport subsystem 98 includes three electric low-pressure pumps 104 run by an electrical system of the outboard motor 10. The pumps 104 are arranged above one another on the side of the crankcase member 56. As best seen in FIG. 3, each pump 104 is mounted to a boss 152 formed on the side of the crankcase member 56.

With reference to FIGS. 1 and 5, a delivery conduit 154 connects an effluent port of the lower-most transport pump 104 to the fuel bowl 100 of the vapor separator 110. Conduit segments coupled to T-fittings connect the effluent ports of the upper transport pumps 104 to the delivery conduit 154 to deliver fuel to the fuel bowl 110.

The delivery conduit 154 extends up the side of the crankcase member 46 and extends around the front end of the engine 12, passing over the upper throttle body 62 of the induction system. The deliver conduit 154 connects to the fuel vapor separator 110 on the other side of the induction system.

As seen in FIG. 6, the delivery conduit 154 extends behind the fuel rail 128 and connects to an inlet port 156 of the vapor separator 110. The inlet port 156 lies on the upper side of the vapor separator 110.

In the illustrated embodiment, the vapor separator 110 and high-pressure pump 122 lie within an integral housing 158 which is attached to the engine block assembly 26 and crankcase member 56. Bolts passing through flanges 160 of the housing 158 secure the housing 158 to the engine 12.

Figure 7:
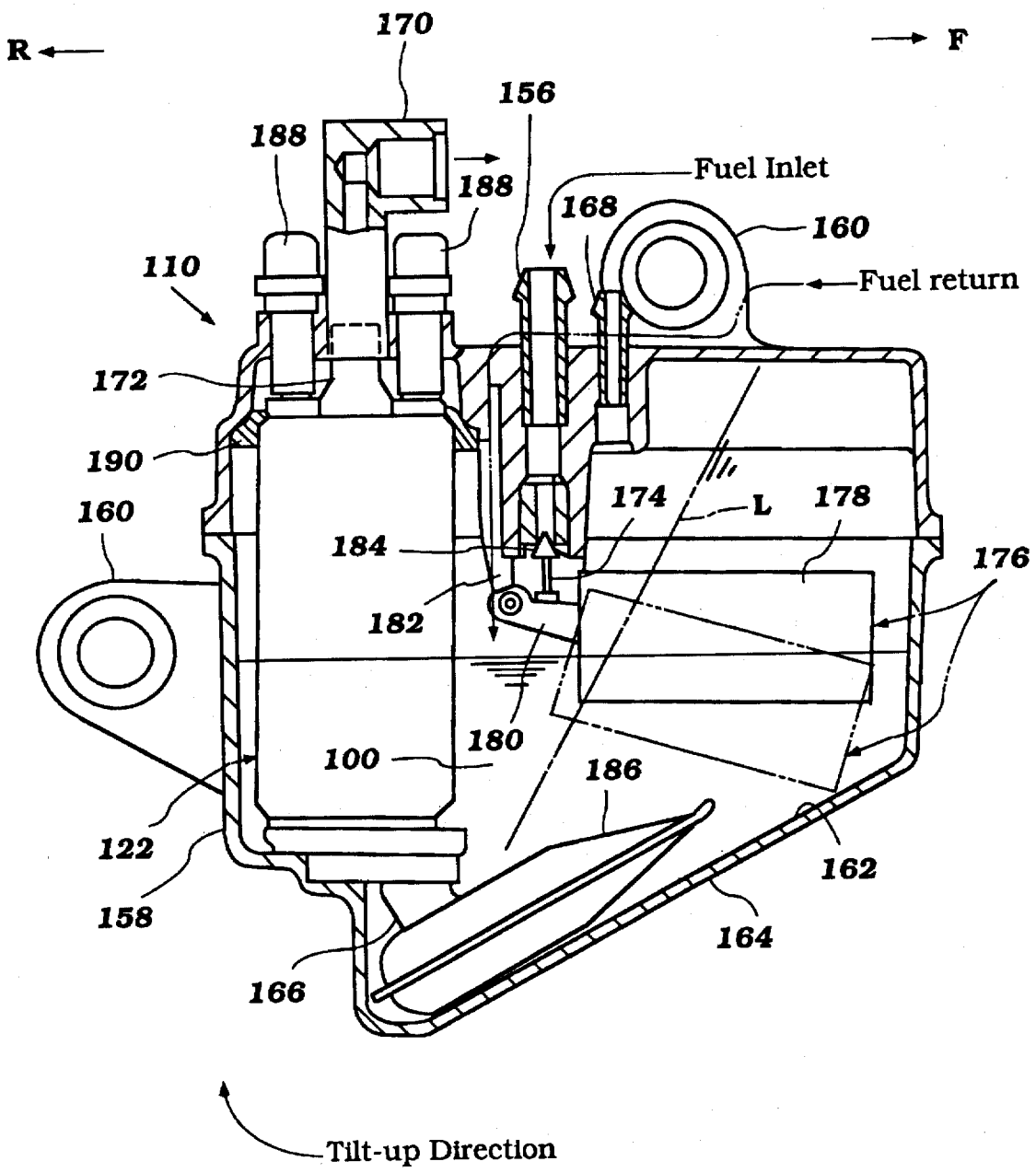
FIG. 7 is a cross-sectional side elevational view of a vapor separator of the fuel supply system of FIG. 1.

With reference to FIG. 7, the housing 158 defines an inner cavity 162 which defines the fuel bowl 100 of the vapor separator 110. The housing 158 also houses the high-pressure pump and motor assembly 122. The slopped bottom surface 164 of the housing 158 funnels the fuel toward an influent port 166 of the pump 122 positioned generally at the bottom of the fuel bowl 100.

The housing 158 defines the inlet port 156, a return port (not shown), a vapor discharge port 168 and an outlet port 170. The outlet port 170 directly communicates with an effluent port 172 of the high-pressure pump 122. The vapor discharge port 168 is positioned to the side of the inlet port 156 at a position proximate to an upper end of the housing 158. The vapor discharge port 168 communicates with the conduit 112 leading to the canister 114, and the outlet port 170 communicates with the conduit 126 leading to the fuel rail 128.

The inlet port 156 connects to the delivery conduit 154 extending from the low pressure pumps 104. A needle valve 174 operates at a lower end of the inlet 156 to regulate the amount of fuel within the fuel bowl 100. A float 176 within the fuel bowl 100 actuates the needle valve 174. The float includes a buoyant body 178 supported by a pivot arm 180. The pivot arm 180 is pivotably attached to an inner flange 182 within the housing 158 at a point proximate to the lower end of the housing inlet 156. The pivot arm 180 also supports the needle valve 174 in a position lying directly below a valve seat 184 formed at the lower end of the inlet 156. Movement of the pivot arm 180 causes the needle valve 174 to open or close the inlet 156 by either seating against or moving away from the valve seat 184, depending upon the rotational direction of the pivot arm 180.

When the fuel bowl 100 contains a low level of fuel, the float 178 lies in a lowered position (as represented in phantom lines in FIG. 7). In the lowered position, the needle valve 104 is opened and fuel flows from the low pressure pumps 104, through the delivery conduit 154 and into the fuel bowl 100 through the inlet port 156. When the fuel bowl contains a preselected amount of fuel, the float 178 rises to a level where it causes the needle valve 104 to seat against a valve seat 184 at the lower end of the inlet port 156. The preselected amount of fuel desirably corresponds to an amount of fuel that would not fill the fuel tank above the vapor discharge port 168 when the outboard motor is in its tilt-up position. Line L in FIG. 7 represents the fuel level in the fuel bowl 100 when the outboard motor 14 lies in its tilt-up position.

The high pressure pump 122 draws fuel into its influent port 166 through a fuel strainer 186 which lies generally at the bottom on the fuel bowl 100. The pump 122 can be driven in any know manner, such as, for example, by an electric motor (as illustrated) or directly by the engine output shaft. In the illustrated embodiment, the electrical contacts 188 to the motor lie outside the fuel bowl 100. A seal 190 also seals the electronics of the motor from the vapors in the fuel bowl 100.

As seen in FIG. 6, a first section of the conduit 126 extends from the outlet port 170 of the housing 158 down to an inlet port of the fuel filter 124. The inlet port desirably lies on the bottom side of the fuel filter 124. A second section of the conduit extends from the outlet port of the fuel filter 124 back down to the inlet port of the fuel rail 132. In the illustrated embodiment, the outlet port of the filter 124 lies on the top side of the filter 124.

The return line 138 connects the outlet port 140 of the fuel rail 128 to the return port of the vapor separator 110. In the illustrated embodiment, the outlet port 140 lies above the return port of the vapor separator such that the return line extends down along the side of the fuel rail 128, between the fuel rail 128 and the intake manifold 78.

The above-described arrangement of the fuel supply system 10 separates the fuel transport subsystem 98 from the fuel delivery subsystem 120 to simplify the layout of the components of the subsystems 98, 120 on the engine 12. This arrangement also places the high-pressure pump 122 in close proximity to the fuel rail 128 and fuel injectors 90.

These advantages of course are also applicable to other types of engines. For instance, with a direct injection engine, the high-pressure fuel delivery subsystem can be positioned proximate to the fuel injectors, near the cylinder head assembly of the engine. If the engine has a V-type arrangement, the fuel delivery subsystem can lie within the valley formed between the cylinder banks with the fuel transport system lying on a side of the engine. The present invention therefore finds applicability with two-cycle and four-cycle engines, with direct and indirect injection engines, with carbureted engines, and with engines of various cylinder arrangements (e.g., V-type or in-line arrangements).

With reference to the schematic illustration of FIG. 2, an electronic control unit 192 (ECU) controls the operation of the engine 14. That is, the ECU 192 controls the fuel injection (both timing and duration), ignition timing, and the fuel flow rate through the high-pressure delivery subsystem 120 of the fuel delivery system 10, as explained below. The ECU 192 also can control other engine functions, as known in the art.

The ECU 192 communicates with a sensory system which detect a number of engine and ambient conditions. In the illustrated embodiment, the sensory system detects air flow into the engine. For this purpose, the sensory system includes a crankcase pressure sensor 194 and a crankcase angle position sensor 196. The crankshaft angle detector 196 measures the crank angle of the crankshaft 16 and generates an input signal indicative to the crank angle. The crankcase chamber pressure sensor 194 measures the pressure within the respective crankcase chamber 58 and generates an input signal indicative of the pressure. Based on this information, the ECU 192 can arcuately determine the air flow into the engine 14 by measuring the pressure within a crankcase chamber 58 with the crankshaft 16 at a particular crank angle, and can calculate the necessary fuel amount to maintain the desired fuel air ratio for the current operation condition of the engine 14.

A throttle angle detector 198 detects the opening degree of the throttle device 60 (e.g., the angular orientation of the throttle valve) and generates an input signal indicative of the throttle opening degree.

An temperature sensor 200 positioned in the intake passage for each cylinder senses the temperature of intake air flowing into the crankcase chamber 58. The temperature sensor 200 generates an input signal indicative of the temperature of the intake air into the crankcase chamber 58.

A pressure sensor 202 and a knock sensor 204 are mounted to the cylinder head assembly 46 and the cylinder block assembly 26, respectively. The pressure sensor 202 measures the pressure within the combustion chamber and generates an input signal indicative of the sensed pressure. The knock sensor 204 sensors if the engine begins to knock (i.e., detonate or ping) and generates an input signal which indicates the presence of this condition, as known in the art. The ECU 192, in response, retards spark timing unit the knock stops.

The sensory system can also includes sensors which detect several other operating characteristics of the engine 12. For instance, a back pressure sensor 206 measures exhaust back pressure. Although not illustrated, this sensor can be mounted in an expansion chamber within the drive shaft housing 20. The back pressure sensor 206 generates an input signal indicative of the sensed back pressure.

An engine temperature sensor 208 determines the engine temperature. The sensor 208 generates an input signal indicative of the engine temperature under the operating state.

A trim angle sensor 210 is provided adjacent the trim pin 212 to provide an input signal indicative of the trim angle of the outboard motor 14.

A transmission sensor 214 determine the operational condition of the drive: e.g., forward, neutral or reverse. The sensor 214 produces an input signal which indicates the condition of the transmission as to whether the transmission is in a neutral or a driving condition.

In addition to the above operational conditions, the sensory system can also determine several ambient conditions, such as atmospheric air pressure and inlet water temperature. A temperature sensor 216 measures the temperature of the cooling water drawn into the outboard motor 14 from the body of water in which the watercraft is operated. The cooling water is circulated through the cooling system of the engine 12 and is then returned to the body of water in any of a variety of conventional manners.

The ECU 192 communicates with the sensors and receives input signals from them. The ECU 192 includes a fuel injection controller. In response to the input signals, the fuel injection controller generates an appropriate output signal to control the fuel injection amount and the fuel injection timing of the fuel injectors 90. The controller also varies the pump speed of the high-pressure pump 122 depending upon the operational condition of the engine.

A throttle controller of the ECU 192 also receives input signals from the sensors. Based on the input information, the throttle controller controls the opening degree of the throttle devices 60. The throttle controller produces an output signal which is received by the throttle actuator (not shown) that operates the throttle shafts 66.

The ECU 192 also includes an ignition controller which likewise receives the input signals from the sensors. The ignition controller controls ignition timing and produces an output signal received by the ignition system 52 which causes the spark plugs 50 to fire in a known manner.

As seen in FIG. 2, the ignition system 52 includes a capacitor discharge ignition circuit 218 (CDI) which is charged by the output of a convention charging coil (not shown). The discharge of a CDI capacitor generated voltage in an ignition coil 220 associated with the spark plug 50, which fires in a well known manner.

The ECU 192 controls the capacitor discharge ignition circuit 218 and the firing of the spark plugs 50. The ECU 192 also controls the fuel injectors 90 to designate both the beginning and the duration of fuel injection and the regulated fuel pressure by adjusting the speed of the high-pressure pump 122. The ECU 192 can operate on any known strategy for the spark control and fuel injection control.

In addition to these control features, the engine 12 can include a feedback control system through which the ECU 192 controls the fuel air ratio in response to the measurement of the actual fuel air ratio by a combustion condition sensor 222, such as an oxygen ($O_2$) sensor.

The engine 12 desirably includes an electrical system which generates electricity used by the engine 12 to charge and fire the spark plugs 50, as well as by other electrical accessories of the watercraft. For instance, the electrical system supplies electricity to the motors of the fuel pumps 104, 122 to drive the motors, to the control system to power the ECU 192, to the ignition system to charge the spark plugs 50, and to a battery for recharging.

The electrical system includes a generator 224 for this purpose. As used herein, the term "generator" means a device which produces an electrical charge (i.e., voltage), including, for example, a DC-type generator and an AC-type generator (known as an alternator). In the illustrated embodiment, the electrical system employs an alternator to produce alternating electrical current.

Figure 8:
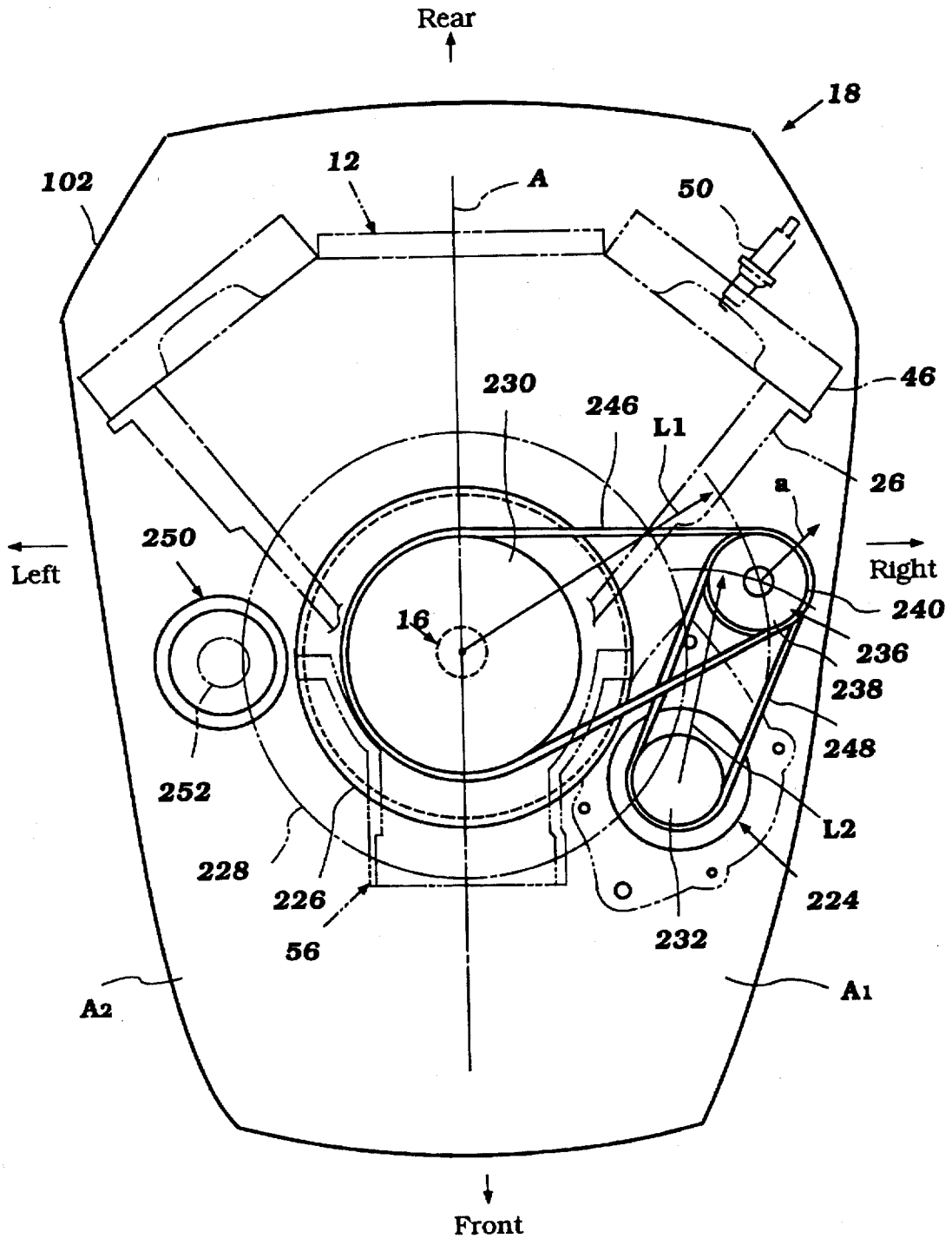
FIG. 8 is a top plan view of an alternator drive mechanism of the marine engine of FIG. 1 with several components of the marine engine illustrated in phantom-lines.
Figure 9:
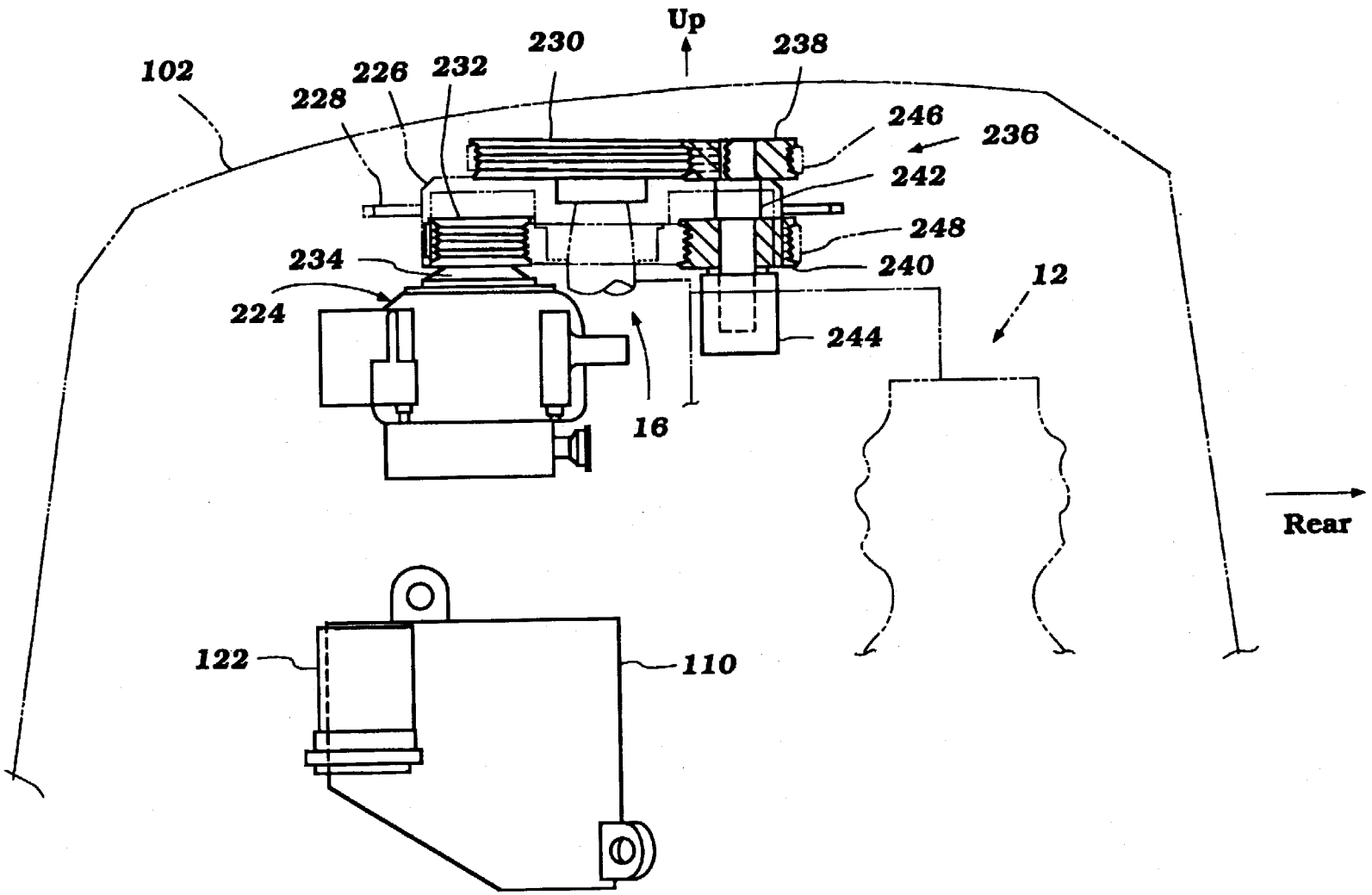
FIG. 9 is a partial, starboard side elevational view of the alternator drive mechanism of FIG. 8.

With reference to FIGS. 8 and 9, the alternator 224 desirably is supported on the side of the engine 12, proximate to the crankcase member 56. In the illustrated embodiment, the alternator 224 lies adjacent to the crankcase member above the fuel vapor separator 110. As seen in FIG. 8, at least a portion of the alternator 224 lies beneath a portion of a flywheel 226 of the engine 12, and more particularly, beneath a portion of a ring gear 228 of the flywheel 226. The flywheel 226 is attached to the crankshaft 16 toward an upper end of the crankshaft 16. In this position, the alternator 224 lies within a recessed portion on the engine's side which is defined between the crankcase member 56 and the induction system (i.e., the intake manifold 78, throttle bodies 62 and intake silencer 70). The perimeter size or girth of the engine 12 is reduced with the alternator 224 mounted to the side of the engine 12 in this position.

The crankshaft 16 drives the alternator 224 through a drive mechanism. In the illustrated embodiment, the drive mechanism comprises a pulley system; however, other drive mechanisms can be used to transfer power from the crankshaft 16 to the alternator 224, as will be readily apparent to those skilled in the art.

A drive pulley 230 (i.e., a crankshaft pulley) of the pulley system is attached to an upper end of the crankshaft 16. In the illustrated embodiment, the drive pulley 230 lies above the flywheel 226 which is attached to the crankshaft 16 in a conventional manner. The drive pulley 230 desirably has a diameter smaller than the diameter of the flywheel 226.

The alternator 224 includes a driven pulley 232 attached to a rotor shaft 234 (FIG. 9) of the alternator 224. Rotation of the pulley 232 causes the alternator rotor (not shown) to spin within the stator assembly (not shown) of the alternator 224, as known in the art. As the rotor spins inside the alternator 224, an alternating magnetic polarity is produced, which generates AC current.

The driven pulley 232 of the alternator 224 has a substantially smaller diameter than the drive pulley 230. The ratio between the diameter sizes of drive pulley 230 and the driven pulley 232 produces a desired spin rate (i.e., rotational speed) of the alternator 224. For example, the diameter of the drive pulley 230 is about 3 times larger than the diameter of the driven pulley 232, such that the alternator rotor shaft 234 rotates at about 3 times the rotational speed as the crankshaft 16.

As seen in FIG. 8, an intermediate compound pulley assembly 236 operates between the drive pulley 230 and the driven pulley 232. The compound pulley assembly 236 includes an upper and lower pulleys 238, 240 supported by an intermediate shaft 242. The shaft 242 rigidly connects together the upper and lower pulleys 238, 240, such that both pulleys 238, 240 rotate together at the same speed.

In the illustrated embodiment, the upper and lower pulleys 238, 240 have about the same diameter size as that of the driven pulley 232. The intermediate compound pulley assembly 236 therefore rotates at the same rotational speed as the driven pulley 232; however, those skilled in the art will appreciate that the sizes of the pulleys of the intermediate compound pulley assembly 236 can designed to increase the speed at which the driven pulley 232 rotates.

The shaft 242 lies generally parallel to the vertical axis V of the crankshaft 16 and to a rotational axis of the alternator rotor shaft 234. As best seen in FIG. 9, a support carrier 244, which is connected to the cylinder block assembly 26, supports a lower end of the intermediate shaft 242. The lower end is journaled within an aperture of the support carrier 244, and is releasably connected to the support carrier 244 to prevent axial movement of the shaft 242 relative to the support carrier 244. The coupling between the support carrier 244 and the shaft 242 maintains the shaft 242 in the desired generally vertical orientation.

As seen in FIG. 8, the shaft 242 lie beyond the peripheral edge of the ring gear 228. In the illustrated embodiment, the shaft position also places the upper and lower pulleys 238, 240 beyond the peripheral edge of the ring gear 228; however, the position of the shaft 242 or the size of the pulleys 238, 240 can be changed such that one or both of the upper and lower pulleys 238, 240 overlap, either above or beneath, a portion of the ring gear 228. In this position, the shaft 242 lies at a distance L1 from the vertical axis V of the crankshaft 16 (i.e., the rotational axis of the drive pulley 230) and a distance L2 from the rotational axis of the alternator rotor shaft 234. The distance L1 between the axis of crankshaft 16 and the intermediate shaft 242 is greater than the distance L2 between the rotor shaft 234 and the intermediate shaft 242.

An upper belt couples the upper pulley 238 of the compound pulley assembly 236 to the drive pulley 230, and a lower belt 248 couples the lower pulley 240 of the pulley assembly 236 to the driven pulley 232. In the illustrated embodiment, as seen in FIG. 9, the belts 246, 248 are ribbed V belts with longitudinal ribbing on the undersides of the belts 246, 248. The grooves of the pulleys 230, 232, 238, 240 have corresponding shapes to cooperate with the belts 246, 248.

As seen in FIG. 8, the upper belt 246 has a longer length that the lower belt 248 due to the differences in pulley sizes and to the differences in distances L1, L2 between the crankshaft 16 and the intermediate shaft 242, and the alternator rotor shaft 234 and the intermediate shaft 242. As seen in FIG. 9, the upper belt 246 desirably has a minimum thickness within acceptable engineering limits and standard sizes in order to minimize the height of the pulley assembly above the flywheel 226. In this manner, the overall height of the engine 12 is reduced in comparison to prior engine designs.

In the illustrated embodiment, the upper belt 246 has a thinner width than the lower belt 248. The lower belt 248 can have a larger width because the width of the belt 248 at this location does effect the overall height of the engine 12.

As understood from FIG. 8, the support carrier 244 and the intermediate shaft 242 are coupled to the engine 12 in a manner allowing the intermediate pulley assembly 236 to move in direction a. Movement of the intermediate pulley assembly 236 in direction a increases the lengths of the distances L1 and L2 between the intermediate shaft 242 and the crankshaft 16, and between the intermediate shaft 242 and the alternator rotor shaft 234. In this manner, the intermediate pulley assembly 236 also acts as a belt tensioner to place both belts 246, 248 in tension and to facilitate replacing the belts 246, 248. The support carrier 244 also can be spring biased to maintain tension on the belts 246, 248 and prevent the belts 246, 248 from slipping on the pulleys.

The movable coupling between the support carrier 244 and the cylinder block assembly 26 can be accomplished in any of a variety of ways well known to those skilled in the art. For instance, the support carrier 244 can be supported by a bracket or arm which includes an elongated slot which extend in direction a (FIG. 8). A fastener can secure the support carrier 244 to the bracket, which in turn is rigidly attached to the cylinder block 26. By loosening the fastener, the support carrier 244 can be moved over the bracket along the travel path defined by the longitudinal slot.

As seen in FIG. 8, the alternator 224 and the compound pulley assembly 236 lie on one side of the central plane A of the engine 12 and a starter motor 250 lies on the other side. The starter motor 250 is positioned to engage a pinion gear 252 of the starter motor 250 with the ring gear 228 on the flywheel 226. This arrangement of these engine components minimizes the width of the engine 12 at its upper end. The arrangement also streamlines the shape of the cowling 102 surrounding the engine 12.

Figure 10:
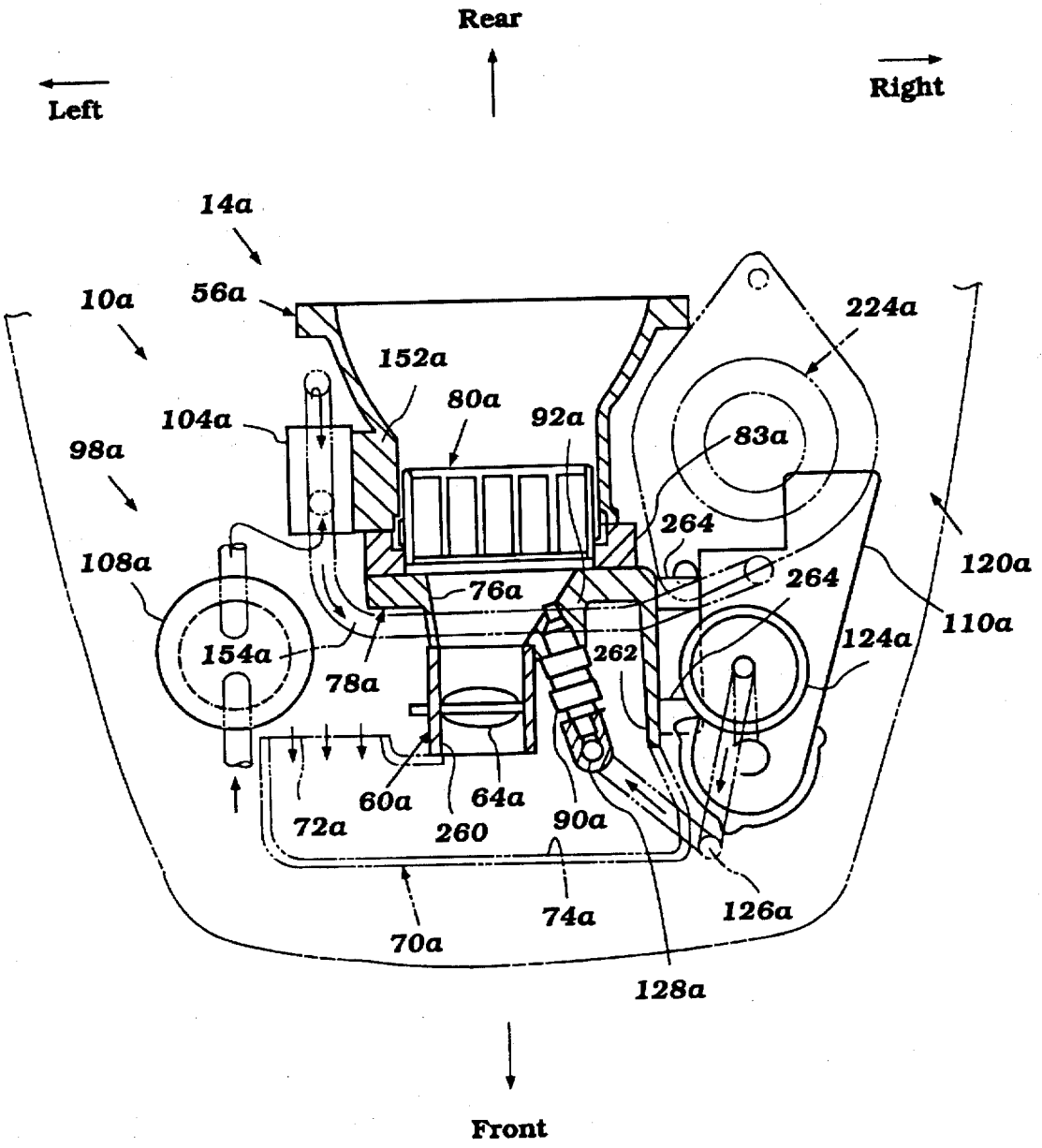
FIG. 10 is a partial top plan view of an engine including an induction and fuel delivery system in accordance with another embodiment of the present invention.
Figure 11:
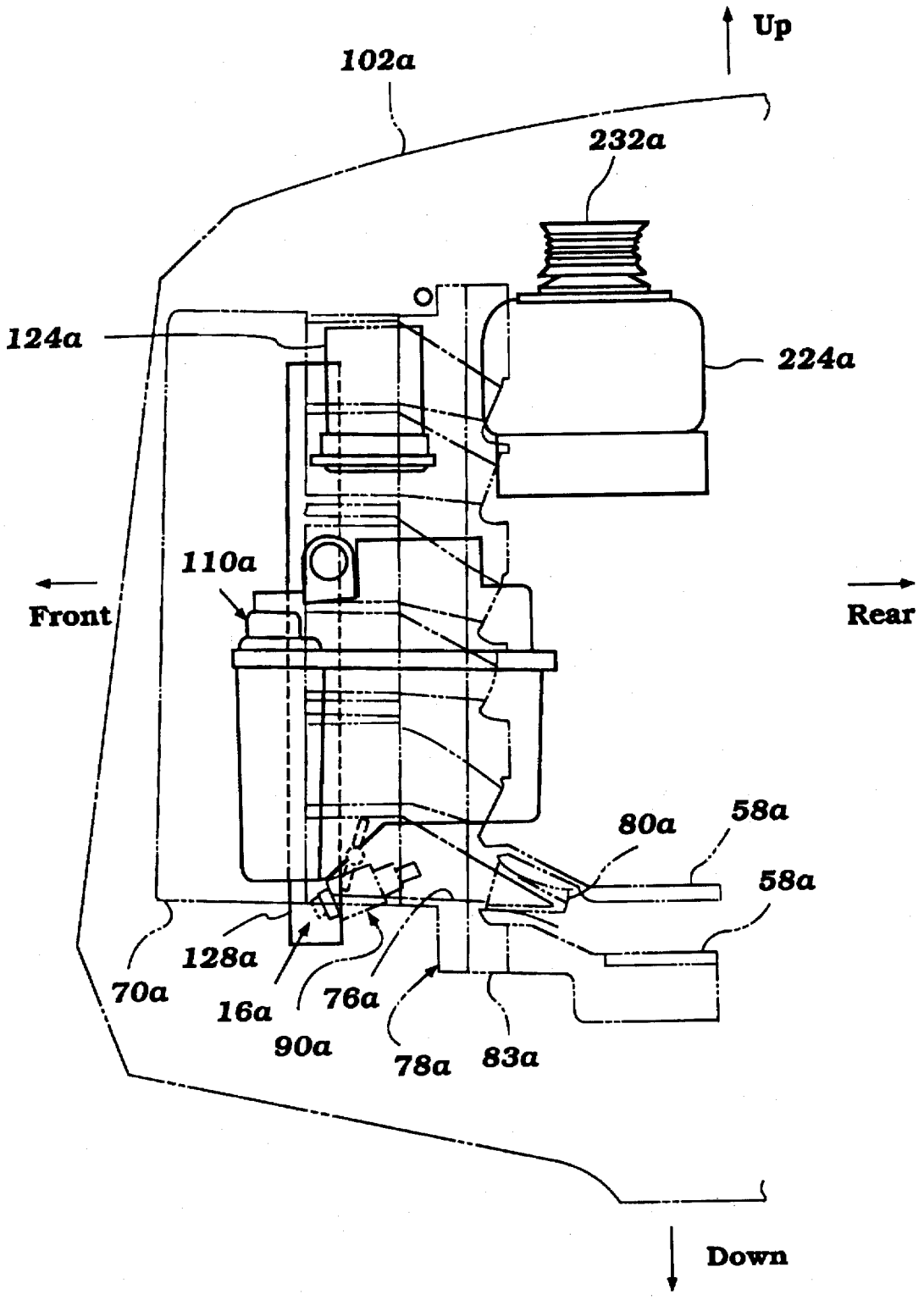
FIG. 11 is a partial starboard side elevational view of the fuel delivery system of FIG. 10.

FIGS. 10 and 11 illustrate another embodiment of the present fuel supply system in accordance with the present invention. Where appropriate, like reference numbers with an "a" suffix have been used to indicate like parts of the embodiments for ease of understanding.

As seen in FIG. 10, each throttle valve **64*a* lies within a throat 260 of the respective intake passage 76*a* of the intake manifold 78*a*. The intake manifold 78*a* includes a channel 262 which extends substantially along the length of the intake manifold 78*a* at a position adjacent to the throttle valves 64*a*. A plurality of bosses 92*a* lie within the channel 262. Each boss 92*a* is positioned to the side of a respective intake passage 76*a*. The boss 92*a* receives a fuel injector 90*a* which is disposed so that its spray axis injects toward the center of the corresponding valve 80*a*. The body of each fuel injector 90*a* lies within the channel 262**.

A fuel rail **128*a* supplies fuel to each of the fuel injectors 90*a*. The fuel rail 128*a* extends along the upper end of the channel 262 on the inlet side of the intake manifold 78*a*. In this position, the fuel rail 128*a* covers only a portion of the channel 262 to allow air circulation within the channel 262. A portion of the fuel rail 128*a* also projects beyond the end surface of the intake manifold 78*a* into a chamber 74*a* defined within an intake silencer 70*a***.

The intake silencer 70a is attached to the opposite side of the intake manifold 78a from the crankcase member 56a. The silencer 70a includes an inlet 72a positioned to the side of the intake manifold 78a so as to draw air into the induction system from the interior of the cowling 102a. The inlet 72a opens into the chamber 74a which has a volume substantially larger than the volume of one of the intake passages 76a. In the illustrated embodiment, the silencer 70a has a width substantially larger than the width of the intake manifold 78a.

Air flows into the silencer chamber 74a from a point on the peripheral side of the cowling 102a through the silencer inlet 72a. When the throttle valve 64a is opened, air flows through the intake passage 76a. Air also circulates within the chamber 262 and over the fuel rail 128a. The respective injector 90a injects fuel into the air stream which flows into the crankcase chamber 58a through the reed-type valves 80a. The air/fuel charge is then delivered to the combustion chamber 58a, fired therein and exhausted through the exhaust system in the manner described above.

As seen in FIGS. 10 and 11, the fuel vapor separator 110a and high-pressure pump 122a are mounted to the side of the intake manifold 78a. A pair of bosses 264 support these components 110, 122 of the fuel system 10a in this position. This location places the fuel bowl 100a is closer in proximity to the fuel rail 128a to shorten then length of the circulation loop of the high-pressure fuel delivery subsystem 120a. The fuel filter 124a also is mounted to the intake manifold 78a above the vapor separator 110a.

As common to all of the embodiments described above, the layout of the fuel supply system is simplified by placing the low-pressure fuel transport subsystem on one side of the induction system and the high-pressure fuel delivery subsystem on the other side of the induction system. This arrangement results in less entanglement of the fuel conduits of the subsystems, as well as shortens the length of the circulation loop of the fuel delivery system.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. An engine comprising multiple cylinders and a plurality of crankcase chambers each communicating with a respective cylinder, an induction system attached to a crankcase member of said engine on a side opposite of the cylinders, said induction system comprising a plurality of intake passages which communicate with said crankcase chambers, and a fuel supply system including a low-pressure fuel transport subsystem located on one side of the intake passages of said induction system and a high-pressure fuel delivery subsystem located on an opposite side of the intake passages of said induction system.

2. An engine as in claim 1, wherein said fuel delivery subsystem communicating with at least one charge former of said induction system.

3. An engine as in claim 2, wherein said charger former is a fuel injector.

4. An engine as in claim 1 additionally comprises an output shaft driven by reciprocating pistons operating within said cylinders, said output shaft positioned to rotate about a generally vertical axis.

5. An engine as in claim 4, wherein said fuel supply system additionally comprises an intermediate fuel conduit which interconnects said fuel transport subsystem and said fuel delivery subsystem.

6. An engine as in claim 5, wherein said intermediate conduit extends between said fuel transport and fuel delivery subsystems about an upper portion of said induction system.

7. An engine as in claim 4, wherein said fuel transport subsystem comprises a low pressure pump which draws fuel through a water-separator filter.

8. An engine as in claim 7, wherein said low pressure pump communicates with a fuel tank of a fuel vapor separator within said fuel delivery subsystem.

9. An engine as in claim 8, wherein said fuel vapor separator supported on said engine at a position beneath a generator of said engine.

10. An engine as in claim 9, wherein at least a portion of said generator lies beneath a ring gear on a flywheel of said engine, said flywheel attached to said output shaft at an upper end of said engine.

11. An engine as in claim 9, wherein a high-pressure pump draw fuel from said fuel tank of said fuel vapor separator.

12. An engine as in claim 11, wherein said high-pressure pump communicates with a fuel manifold coupled to a plurality of fuel injectors.

13. An engine as in claim 12, wherein said fuel manifold defines a flow path over inlet ports of said fuel injectors which is generally parallel to said vertical axis about which said output shaft rotates.

14. An engine as in claim 13, wherein said fuel transport subsystem lies on a side of said fuel manifold opposite of said high-pressure fuel pump.

15. An engine as in claim 13, wherein said high-pressure pump communicates with an inlet port of said fuel manifold positioned at a lower end of said fuel manifold.

16. An engine as in claim 15, wherein an outlet port of said fuel manifold communicates with said fuel tank of said fuel vapor separator.

17. An engine as in claim 16, wherein said outlet port lies at an upper end of said fuel manifold.

18. An engine as in claim 1, wherein said fuel transport subsystem communicates with a fuel tank which lies external to an engine compartment housing said engine.

19. An engine as in claim 1, wherein said cylinders of said engine lie in two cylinder banks with the banks having a V-type arrangement, said fuel transport system lying on one side of a central plane which bifurcates said being between said cylinder banks, and said fuel delivery subsystem lying on an opposite side of said central plane.

20. An engine as in claim 1, wherein said induction system includes at least one throttle valve which regulates air flow into said crankcase chambers.

* * * * *